United States Patent [19]

Schultz et al.

[11] 4,377,795

[45] Mar. 22, 1983

[54] CIRCUIT BREAKER WITH SNAP ACTION MAGNETIC TRIP ACTUATOR

[75] Inventors: John T. Schultz; Clifford F. Bishop, both of Cedar Rapids, Iowa

[73] Assignee: Square D Company, Palatine, Ill.

[21] Appl. No.: 287,853

[22] Filed: Jul. 29, 1981

Related U.S. Application Data

[63] Continuation of Ser. No. 90,946, Nov. 5, 1979, Pat. No. 4,307,359.

[51] Int. Cl.[3] ..... H01H 73/48

[52] U.S. Cl. ..... 335/23; 335/35; 335/191

[58] Field of Search ..... 335/191, 21, 23, 35

[56] References Cited

U.S. PATENT DOCUMENTS 3,492,614 1/1970 Angelo et al. ..... 335/191

*Primary Examiner*—Harold Broome

*Attorney, Agent, or Firm*—Larry I. Golden; Norton Lesser; Richard T. Guttman

[57] ABSTRACT

A multipole circuit breaker having a housing with a top wall center recess receiving a center strut of an interior trim. An operating assembly is interconnected with a trip assembly through a transistor link passing beneath the center recess and is operable by the magnetic assembly to assist the operating assembly in separating the breaker contacts in response to a fault current. A closure member overlapped by the interior trim prevents access to the load wires. A voltage reject configuration is provided on the housing to prevent mounting in a panelboard designed to carry voltages higher than that for which the circuit breaker is rated and a jaw assembly for the breaker is disclosed having a plurality of contact positions with each leg of a U shaped bus stab.

3 Claims, 14 Drawing Figures

CIRCUIT BREAKER WITH SNAP ACTION MAGNETIC TRIP ACTUATOR

This is a continuation of application Ser. No. 090,946, filed Nov. 5, 1979, now U.S. Pat. No. 4,307,359.

FIELD OF THE INVENTION

This invention relates in general to circuit breakers and more particularly to a circuit breaker having improved operating characteristics and adapted for use as a high current rated multipole breaker straddling opposite longitudinal mounting rails of a panelboard.

SUMMARY OF THE INVENTION

In U.S. Pat. No. 4,142,225 and in application Ser. No. 009,900 there is described a panelboard assembly utilizing a heat transmitting insulating bus bar support having a resilient mounting rib extending along opposite edges with each rib adapted to receive or engage a recess in a respective circuit breaker housing to secure the respective circuit breaker to the panelboard assembly. The circuit breaker housing carries a terminal which connects to a bus stab located between the mounting ribs and along the central longitudinal axis of the assembly. In the described panelboard assembly the exterior trim is adjustable with respect to the cabinet and the interior trim was recessed in the cabinet as shown in U.S. Pat. Nos. 4,131,932 and 4,162,517 and as shown in U.S. Pat. No. 4,142,225 below the top of the circuit breaker housing providing a low profile.

The circuit breakers disclosed in the mentioned U.S. Pat. No. 4,142,225 and application are located in either of two rows or columns with one end of each breaker housing located substantially halfway between the mounting ribs. A separate row of removable knockouts are provided on opposite sides of a center strut of the interior trim to enable the center portion and handle of a breaker in a respective column to extend through the interior trim, while the housing ends in turn were recessed so as to be overlappingly engaged by the center strut and a respective side strut of the low profile interior trim.

However, in order to accommodate a high current breaker adapted to carry for example as much as 225 amps, it is necessary for the circuit breaker to be made large enough to extend between opposite mounting ribs and in order for the center strut to accommodate the housing it is necessary to lower or depress the profile or top wall of the housing adjacent the center of the housing. This in turn creates a problem in locating the circuit breaker operating assembly and the latch assembly.

In addition Underwriters' Laboratories requires that the load connections for the circuit breaker be inaccessible to metallic objects which may be snaked beneath the interior trim.

It is also desirable that the circuit breaker be provided with means for preventing acceptance of the breaker by a panelboard designed for higher voltages than those adapted to be carried by the circuit breaker.

As mentioned in U.S. Pat. No. 4,142,225 it is desirable that as many points of contact or engagement be provided between the circuit breaker jaws and the panelboard bus stabs as possible to reduce the possibility of heating due to the resistance of the junction creating an $I^2R$ loss. In that patent a circuit breaker jaw having four legs and therefore four independent points of contact with a single U shaped bus stab was disclosed and while this represents an improvement an additional increase in the points or position of independent engagement between the jaws and the bus stabs can further reduce the contact resistance.

SUMMARY OF THE INVENTION

In the present invention a translator link for each pole of a multipole breaker is employed between the operating assembly and the latch of the breaker trip assembly to enable the trip assembly to be separated some distance from the operating assembly. The profile or top wall of the housing is therefore enabled to be recessed in the area between the trip assembly and the operating assembly. This permits the center strut of the interior trim described in the aforementioned patent and related applications to be received in the recessed center portion of the housing while the side struts are received by end recesses of the housing to provide a low profile.

Advantage is taken of this design to also operate the translator link with the armature of the breaker magnetic assembly to utilize the power in a fault current operating the magnetic assembly for assisting the operating mechanism in tripping the breaker to open the breaker contacts. This action shortens the trip time.

In addition the operating and trip assemblies are supported in a metal frame with the translator link pivotally interconnected at opposite ends to the frame and latch. Adjustable tabs are provided on the frame for enabling facile adjustment of the translator link relative the latch assembly for ensuring proper operation.

The load connections of the circuit breaker are overlapped by movable closure member or door which in turn is partially overlapped by a side wall or strut of the interior trim so that removal of the trim and opening of the closure member are necessary before the load connections can be exposed. In addition the housing is provided with a lower wall cooperating with panelboard assembly to permit the circuit breaker to be mounted in the panelboard assembly only if the panelboard assembly is designed to carry current of a voltage corresponding to that of the circuit breaker and for preventing mounting of the circuit breaker in the event the panelboard is designed for a higher voltage.

A further improvement resides in the use of an integral U shaped jaw member for each pole of the breaker with each leg of the U having three spaced segments with one offset from the other two segments to receive a respective leg of the U-shaped bus stab disclosed in the aforementioned patent between the offset segments of each leg so that a total of 6 separate spaced areas of contact are provided. A spring loop biases the offset segments of each leg of the jaw member toward each other so that each leg of the member engages both the inner and outer surface of the respective U shaped stab leg to provide a large area for heat dissipation.

It is therefore one object of the present invention to provide an improved circuit breaker.

It is another object of the present invention to provide an improved multipole circuit breaker for use in panelboards having heat transmitting plastic bus bar supports and an interior trim adapted to be recessed below the top surface of the circuit breaker housing.

Other objects and features of the present invention will become apparent on examination of the following specification and claims together with the drawings.

DESCRIPTION OF THE PREFERRED EMBODIMENT

Figure 1:
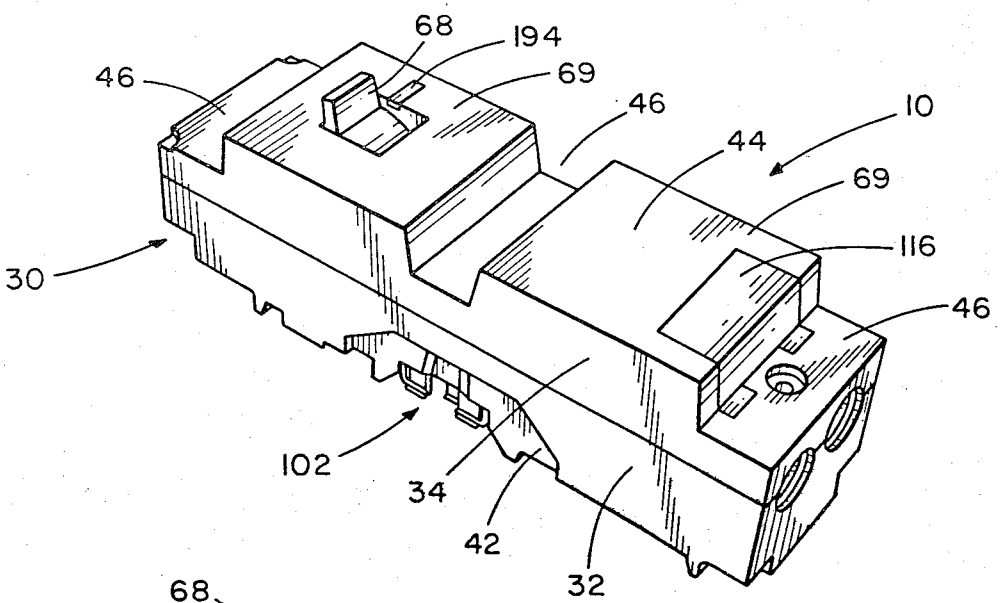
FIG. 1 is an isometric view of a circuit breaker incorporating the principles of the present invention.
Figure 2:
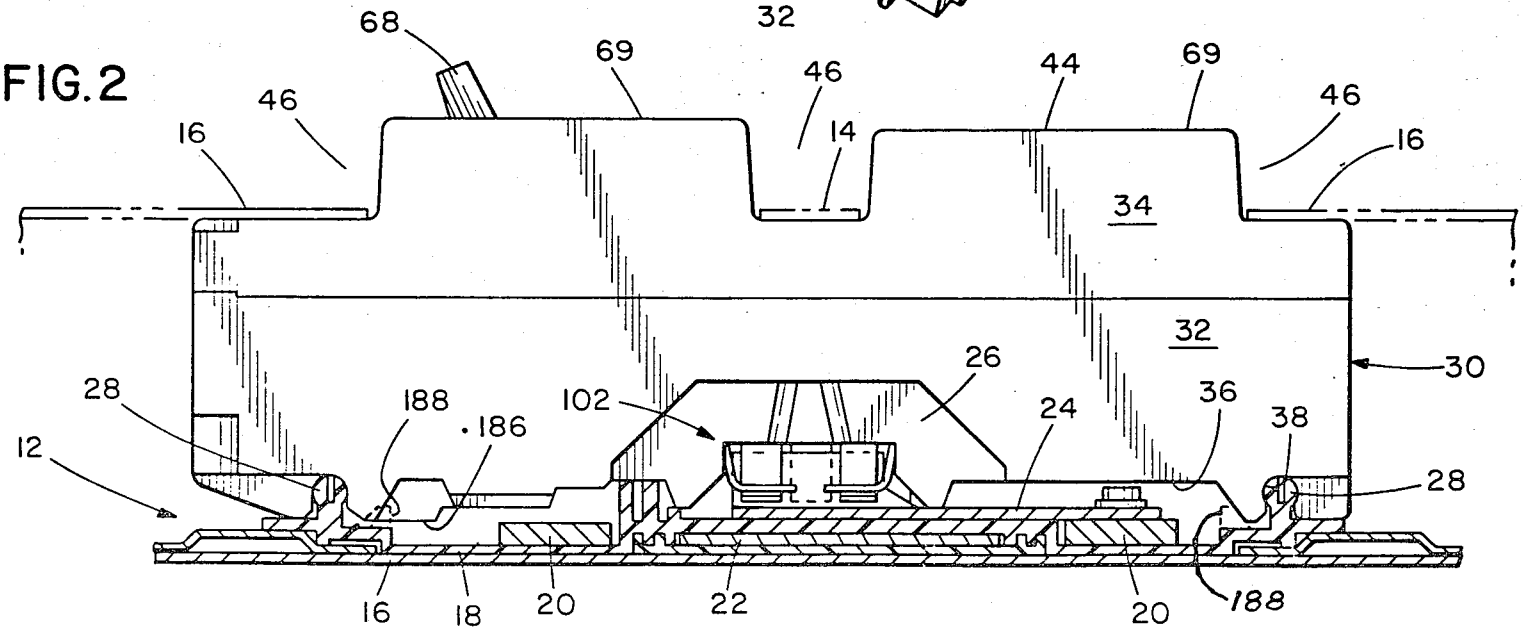
FIG. 2 is a side elevational view of the circuit breaker incorporating the principles of the present invention together with relevant portions of a panelboard assembly.
Figure 8A:
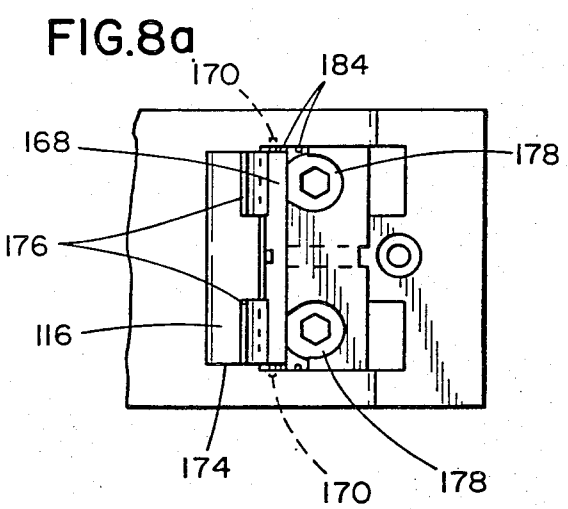
FIGS. 8 and 8*a* are respective fragmentary views illustrating the circuit breakers load connection closure member in open position.

In FIG. 1 a two pole circuit breaker incorporating the principles of the present invention is indicated by the reference character 10 for use in a panelboard assembly indicated by the reference character 12 in FIG. 2. It will be appreciated that the two pole circuit breaker 10 is exemplary of one embodiment of the invention and that the breaker may incorporate less or more poles and typically may include three poles.

The panelboard assembly 12 is similar to the type of panelboard assembly described in U.S. Pat. No. 4,142,225 and applications mentioned therein or can be similar to of the type of panelboard assembly described in application Ser. No. 009,900 and utilizes an interior trim or hopper having knockouts located in respective columns between a center wall or strut 14 and side walls or struts 16 indicated by broken lines. The panelboard assembly is supported on the rear wall 16 of a cabinet and the interior trim is supported on assembly 12.

As described in the aforementioned U.S. Pat. No. 4,142,225, the removal of a knockout in one column permits access to the handle portion of a single pole circuit breaker located on a respective side of the center strut 14 with end portions of the circuit breaker housing recessed to receive the center strut and a respective side strut and if two single pole circuit breakers are located in end to end relationship with each other a housing portion and handle of each projected through a respective knockout on opposite sides of the center strut.

The panelboard assembly 12 includes a longitudinally extending insulating member or assembly 18 carrying a plurality of longitudinally extending spaced apart side bus bars 20 and a center bus bar 22 in insulated heat transmitting relationship to the back wall 16 of the cabinet. The center bus bar is overlapped by an insulating portion to permit longitudinally spaced bus stabs 24 secured to respective side bus bars to be positioned in overlapping relationship to the center bar 22 while passages in the insulating portion overlapping the center bar 22 permits bus stabs to be connected to the center bar 22. The bus stabs 24 each have a U shaped portion overlapping the center bar 22 and located in a respective compartment defined by longitudinally spaced insulating partition or barrier walls 26.

As mentioned, the circuit breaker described in the aforementioned patent is a single pole breaker and has one housing end recess engaged with a respective one of two mounting rails 28 extending along opposite edges of the member 18. A jaw at the other end of the breaker housing connects to a bus stab 24 overlapping the center bus bar 22 and located beneath the center strut 14. The breaker housing terminated beneath the center strut so two breakers could connect in end to end relationship to a the U shaped portion of a single bus stab, while the recessed portions at opposite ends of each housing receive the respective side and center struts 14 and 16 and defined a projecting portion extending through a respective knockout for ready access to the circuit breaker handle.

Figure 3:
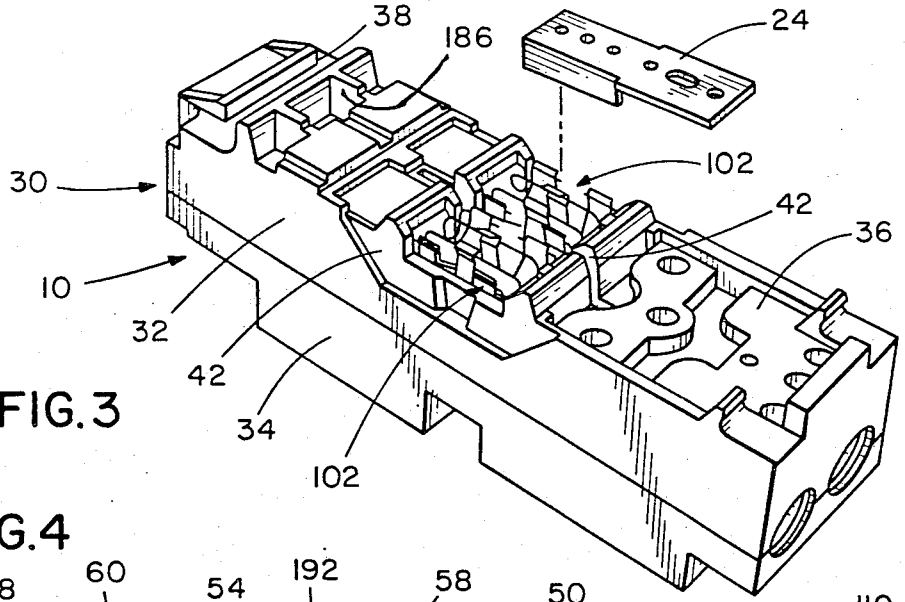
FIG. 3 is a bottom isometric view of the circuit breaker shown in FIG. 1 together with one bus stab adapted for connection thereto.
Figure 4:
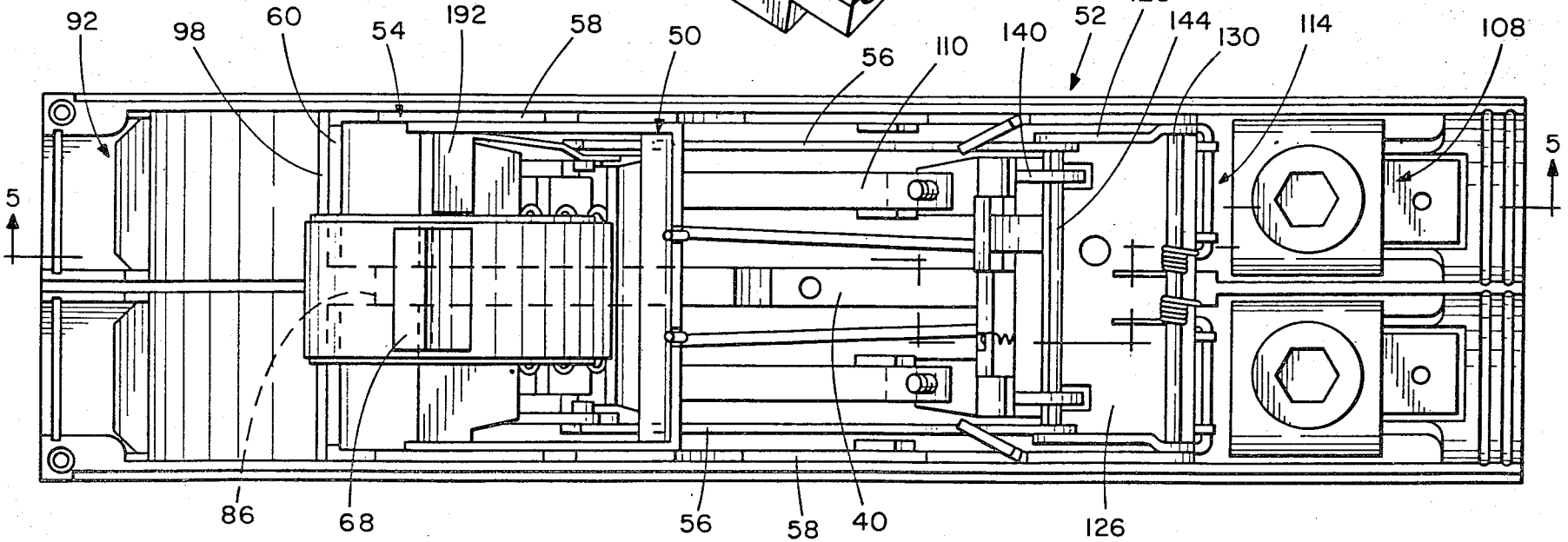
FIG. 4 is a top elevational view of the circuit breaker shown in FIG. 1 with the housing cover removed.

In the present application the circuit breaker 10 is a multipole breaker adapted to carry 225 amperes and while illustrated as a two pole breaker, it is not limited thereto and may include three poles, as will become obvious. The breaker 10 includes a housing 30 extending across two adjacent longitudinally spaced compartments and between the two spaced mounting rails 28 located along opposite edges of the insulating member 18. The housing 30 includes a base 32 and cover 34 with the bottom wall 36 of the base 32 having a mounting recess 38 at one end of the type described in the aforementioned patent for snap fit engagement with either mounting rail 28 and a recess at the other end for receiving the opposite rail. The base 32 has side walls and end walls defining a cavity and registering with similar shaped and dimensioned walls of the cover 34. A center barrier or partition wall 40 of the base projects from the bottom wall 36 of the base into the cavity to define a compartment for each pole of the breaker as best seen in FIG. 4 and shown by dotted lines in FIG. 5. In addition the bottom wall 36 is provided with a recess 42 best seen in FIG. 3 extending into the wall 40 for receiving a barrier or compartment wall 26 of the insulator 18 straddled by the breaker. The side walls of the base 32 also each have a recess for receiving adjacent barrier walls 26 of the insulator 18.

Figure 5:
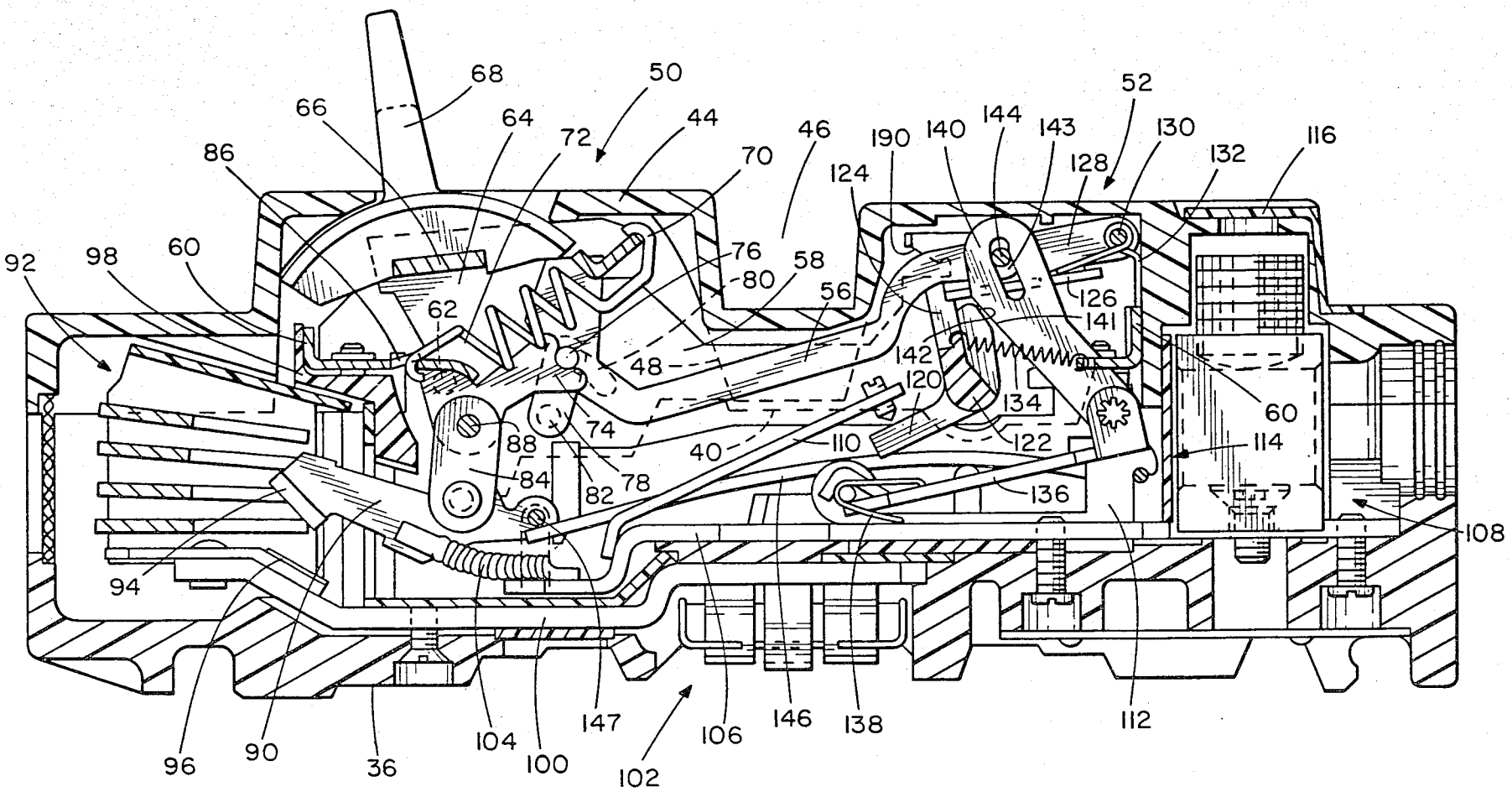
FIG. 5 is a sectional view taken along the line 5—5 in FIG. 4 and illustrating the circuit breaker in OFF position with certain portions offset from the plane of the section indicated by dotted lines.

The cover 34 in addition to side and end walls registering with the base includes a top wall 44 having center and end recesses 46 to accommodate the center and side struts 14 and 16 of the interior trim 14. Depending wall 48 coincident with the recesses 46 and the wall 40 of the base extends from the top wall as seen in FIG. 5 to cooperate with wall 40 in defining a compartment for each breaker pole.

The circuit breaker 10 includes an operating assembly 50 spaced from a trip latch assembly 52 in order to enable the center recess 46 to be formed in cover 34 for accommodating the center strut 14 of the interior trim.

The operating assembly 50 and the trip assembly 52 are supported at spaced apart positions by an elongate frame 54 in the base 32 and are interconnected by a pair of translating links 56 as best seen in FIGS. 4–7.

The frame 54 includes spaced side walls 58 interconnected by integrally formed end struts 60 and having cutout portions adjacent the center recess 46 to permit the cover wall to be recessed. Walls 58 are nestingly received in close fitting relationship to the side walls of the housing base 38 and each end strut 60 is secured to the central or compartment wall 40 of the breaker. The side walls 58 each have a short pivot 62 adjacent one end pivotally supporting a respective leg of a U shaped handle arm 64. A strut 66 extends between the legs of the arm 64 and is secured to the arcuate portion of a handle 68. The handle and spaced portions 69 of the housing project through respective openings in the top wall 44 of the housing cover formed by corresponding pairs of knockouts on respective sides of the center strut 14 of the trim.

A pair of spaced apart coil springs 70 interconnect the back leg of the handle arm 64 with the back leg 72 of a U shaped upper link member 74 to hold each leg of the link 74 in pivotal engagement with a respective translatable pivot pin 76. Each pin 76 extends through a respective translator link 56 and a respective cradle arm 78 located between the respective link 56 and the respective frame wall 58 into an arcuate slot 80 in the respective frame wall 58. The cradle arm 78 carries a pin 82 adjacent the end opposite pin 76 for engagement with a respective leg of the upper link 74 when the operating assembly of the breaker is moved from the ON position to the Trip position. The upper link 74 forms a toggle assembly with a lower link 84 of insulating material for each pole and its movement is adapted to be stopped in the OFF position of the handle 68 as shown in FIG. 5 by a stop tab 86 projecting coincident with center wall 40 from the adjacent end strut 60 of the frame.

The upper link 74 and the lower link 84 for each pole are pivotally interconnected by a pivot pin 88 extending through the side legs of the upper link 74. Each lower link 84 is formed of insulating material and each has a pivot connection with a respective contact blade 90 for each breaker pole intermediate the ends of the respective blade.

Each blade 90 extends in one direction from the link 84 toward an arc stack assembly 92 located adjacent one end of the housing 30. A contact 94 on each blade and adjacent the arc stack assembly 92 is adapted to engage a respective stationary contact 96. In addition an insulating member 98 extending across each pole of the breaker is interposed between the arc stack 92 and the adjacent end strut 60 and to prevent the passage of arc gasses past the strut and the handle opening.

Each stationary contact 96 is fixed to a respective line bar conductor 100 secured to the bottom wall 36 of the base. Conductor 100 extends through a respective passage in the bottom wall 36 to a respective jaw or terminal assembly 102 for each circuit breaker pole. Each jaw 102 engages the side legs of a respective U shaped bus stab 24 as will hereinafter be more fully described in connection with FIGS. 3 and 10–13 to extend a respective circuit from each bus stab 24, through a respective line conductor 100, respective contacts 96 and 94 to a respective blade 90 and from the respective blade 90 through a respective flexible braided conductor 104 to a respective load bar conductor 106. Each load bar conductor 106 partially overlaps the respective line conductor 100 and is insulatingly separated therefrom and extends to a load terminal assembly 108 located at the end of base 32 opposite the arc stack 92.

One end of a respective cantilever bimetal member 110 is secured intermediate the ends of conductor 106 to load conductor 106. Conductor 106 also extends beneath the back leg of a respective U shaped yoke or heelpiece 112 of a magnetic assembly 114.

The load terminal assembly 108 includes respective lug connectors overlapped by an L shaped access door or closure member 116 for connection a respective load wire such as 118 (seen in FIGS. 8 and 9) extending to a load. The door 116 is pivotally secured to the cover 34 at projecting portion 69 and has a pair of tabs overlapped by one of the side walls or struts 16 of the interior trim as will be explained to prevent access to the load connectors without first removing the trim to thereby deter unauthorized or untrained personnel from attempting connection or disconnection of the load wires 118.

Figure 6:
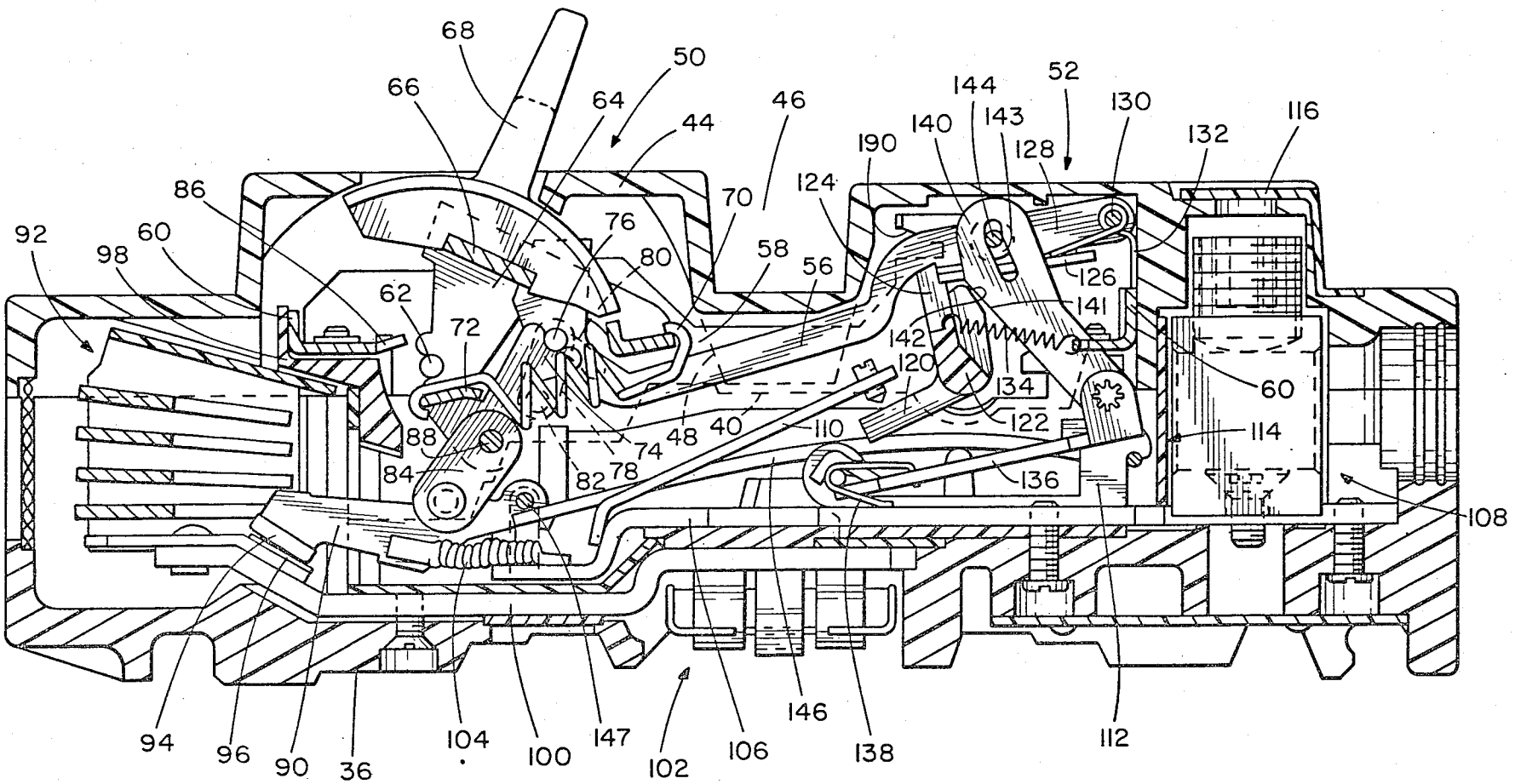
FIG. 6 is a sectional view similar to FIG. 5 illustrating the circuit breaker in the ON position.
Figure 7:
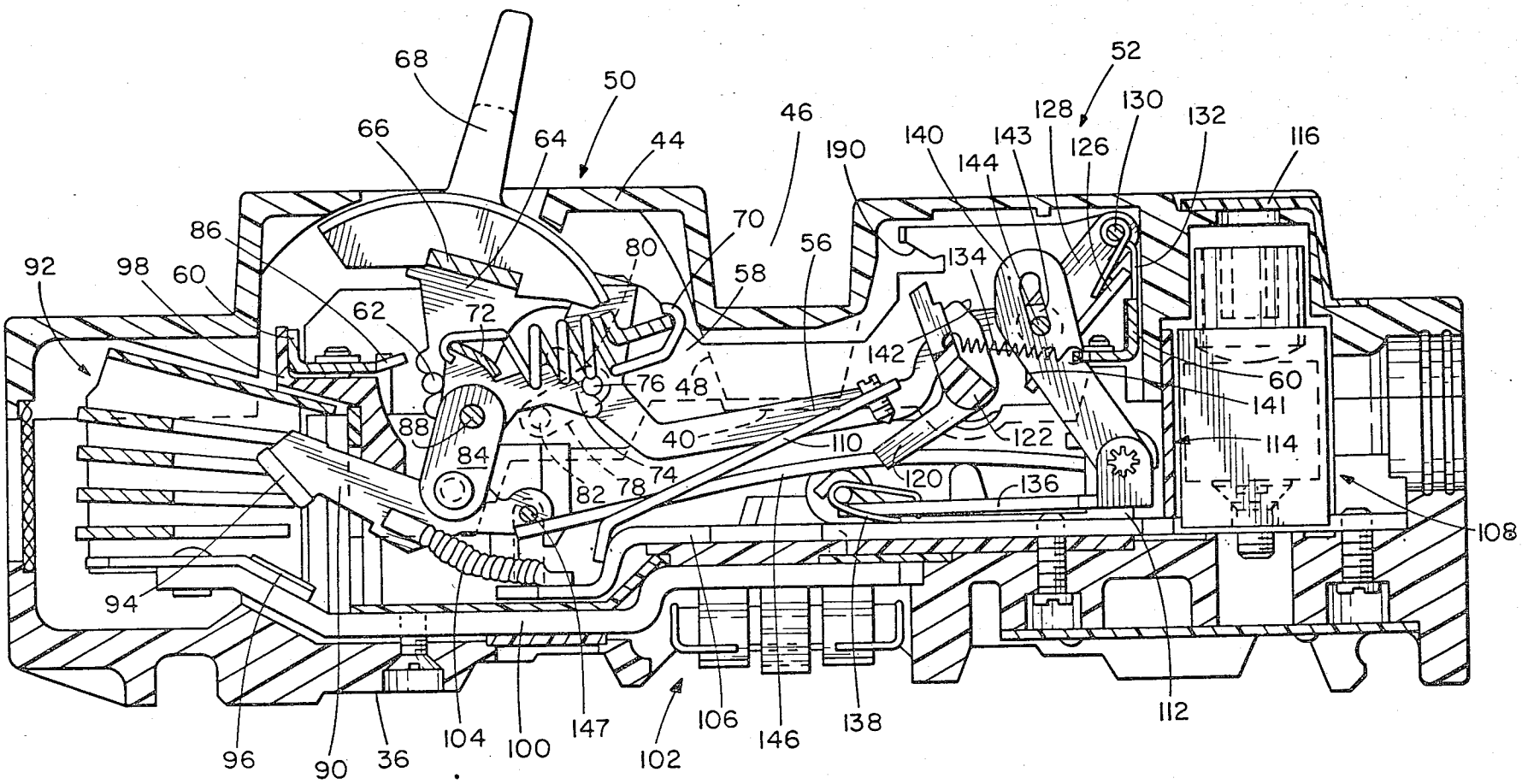
FIG. 7 is a sectional view similar to FIGS. 4 and 5 illustrating the circuit breaker in the TRIP position.

Each cantilever bimetal member 110 extends into overlapping relationship with a respective lever arm or surface 120 of a trip bar 122 forming a portion of the trip or latch assembly 52. The trip bar 122 is formed of insulating material and is pivotally supported adjacent opposite ends in the frame walls 58. An upwardly projecting latch arm 124 on the trip bar 122 is stepped or shouldered adjacent the free end to receive a latch 126 projecting from the back leg of a U shaped latch member 128 whose side legs are pivotally supported on pivot pin 130 extending through the portion of frame walls 58 received in the portion 69 of the housing. A torsion spring 132 wrapped on pin 130 has one leg engaged with the back leg of latch member 128 and the other leg engaged with the adjacent strut 60 to bias the latch 126 in a counterclockwise direction as seen in FIGS. 5, 6 and 7 for engagement with latch arm 120, while a coil spring 134 engaged at one end with strut 60 and at the other end with bar 122 biases the trip bar 122 and latch arm 124 in a clockwise direction to engage the end surface of the latch 126 just above the step or shoulder on the arm 124.

Each U shaped yoke 112 of the magnetic assembly 114 pivotally supports a respective armature 136 in a pair of upstanding ears adjacent one end of the yoke and springs 138 bias the free end of the respective armature 136 from the side legs of the respective yoke 112. The free end of each armature 136 is thus biased upwardly and each carries a respective elongate insulating link 140. Each insulating link 140 extends upwardly and is offset toward trip bar 122 for passage to a position above the trip bar 122 with a cam surface 141 being formed on the insulating link 140 located adjacent a respective lever surface 142 on the trip bar 122.

Adjacent the upper end, each link 140 is provided with an elongate slot 143 having a short vertical portion and then inclined in the direction of the pivot connection of the link to the armature. The slots 143 each receive a translatable pin 144 pivotally interconnecting each translator link 56 with the legs of the U shaped latch member 128.

In addition a respective U shaped wire spring 146 having elongate legs is provided for each circuit breaker pole with the back leg of each spring 146 engaged in notches formed in the side legs of a respective magnetic yoke 112. The free ends of the elongate legs of wire spring 146 extend below a respective pin 147 passing through a respective blade 90 adjacent the blade ends opposite the contacts 94. Each pin 147 is thereby biased to the upper end of a respective recess or slot formed in the central partition wall 40 and in a respective side wall of the base 32. The springs 146 serve to bias the blades 90 counterclockwise about the pivot with link 84 for resisting contact bounce when contact 94 engage a respective contact 96 and also serve to resist blow open forces between the contacts and to apply contact pressure.

Each jaw or terminal assembly 102 as best seen in FIGS. 3 and 10–12 includes a generally U shaped jaw member 148 of cadmium copper having a back leg 150 secured to the planar surface of a respective bar conductor 100 by a pair of spaced bosses 152 formed on the conductor adjacent one end of the bar conductor and extending through a respective recess in the back leg 150. The side legs of each jaw member 148 are each split at spaced positions to form an inwardly spaced central cantilever segment 154 and a pair of outwardly spaced longitudinally offset cantilever segments 156 each transversely offset from the respective central segment 154 for receiving a respective side leg 158 of the U shaped bus stab 24 between the segments 154 and 156.

Each segment 154 and 156 is formed with a reverse bend at the end thereof to form a high pressure contact surface on the portion facing the respective bus stab leg 158 and for capturing a split spring loop 160, which encircles the inwardly and outwardly spaced segments 154 and 156 of each leg to apply a bias against movement of the inner and outer segments from each other and for applying spring pressure to the segments and against legs 158. Each spring loop 160 is formed of stainless steel spring material and comprises an inner portion 162 engaged with an inner surface of a respective segment 154 and extending to one leg of a U shaped bend 164 at opposite ends of portion 162. The U shaped bead 162 supplies the spring force with the back leg of the bend spaced adjacent the conductor 100. A free end portion 166 is formed on the other leg of each U shaped bend 164 with the free portion 166 extending toward each other in generally parallel relationship to leg 162 to engage the outer surface of an respective segment 156. Each leg 166 terminates at a position adjacent the central transverse axis of member 148.

Insertion of a respective bus stab leg 158 between segments 154 and 156 forces the segments apart against the resistance of the wire spring loop 160 and the U shaped bends 164 at opposite ends. Each leg of the U shaped bus stab 24 is therefore engaged at three spaced positions since the segments 154 and 156 can flex independently of each other under spring pressure and therefore a total of six independent positions of engagement are secured between the bus stab and end terminal assembly 102 to minimize the resistance at the connection and therefore the heating effect created by such resistance. The pressure of springs 160 also counteracts any tendency of the contact material to lose contact pressure if deformed under repeated heating and cooling, which is especially a problem if the bus stab is formed of aluminum.

As mentioned previously the door or closure member 116 overlaps the connectors of the load terminal assembly 108. The door is L shaped with one leg 168 having a hinge pin 170 along opposite edges captured in a respective undercut formed along opposite margins of a shallow recess 172 formed in the portion 69 of the top wall 44 overlapping the assembly 108. The door is of thin insulating material which may be flexed for inserting the hinge pins in the undercut and the shallow recess in the portion 69 of the cover is slightly deeper than the thickness of the door and is continued in the vertical surface of portion 69 forming one margin of recess 46 at the corresponding cover end to receive the other leg 174 of the door. The other leg 174 of the door has a pair of short spaced tabs 176 extending perpendicularly therefrom for receipt in respective shallow recesses in the wall 44 at the bottom of the recess 46 for overlapping engagement by a strut 16 to prevent opening of the door.

Figure 8:
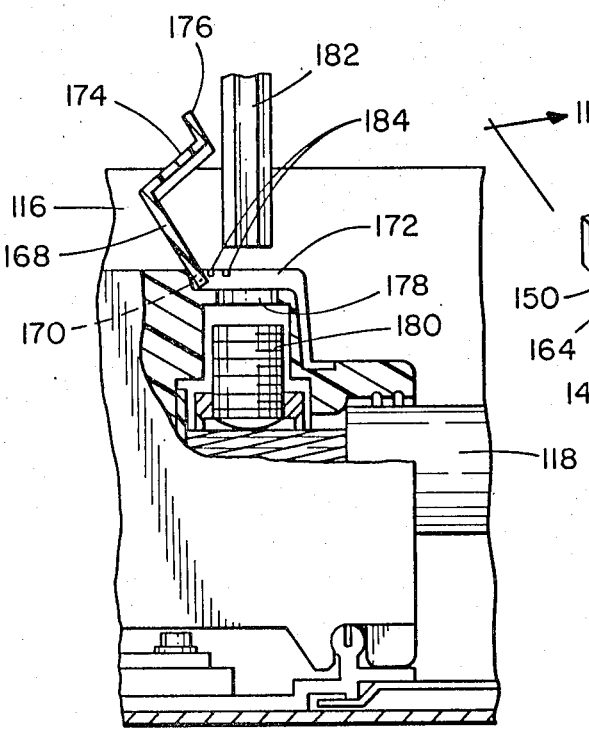
Figure 10:
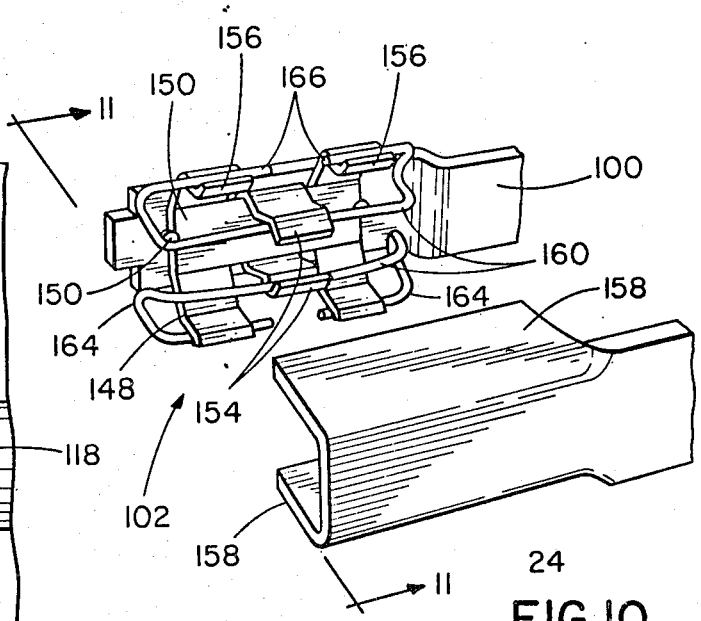
FIG. 10 is an isometric view of the circuit breaker jaw assembly.
Figure 11:
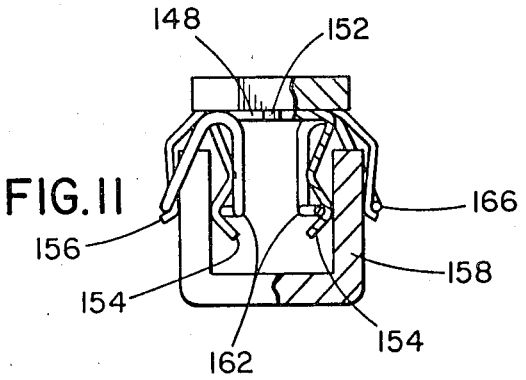
FIG. 11 is a fragmentary sectional view taken along the line 11—11 in FIG. 10 to illustrate the jaw assembly engaged with a bus stab.
Figure 9:
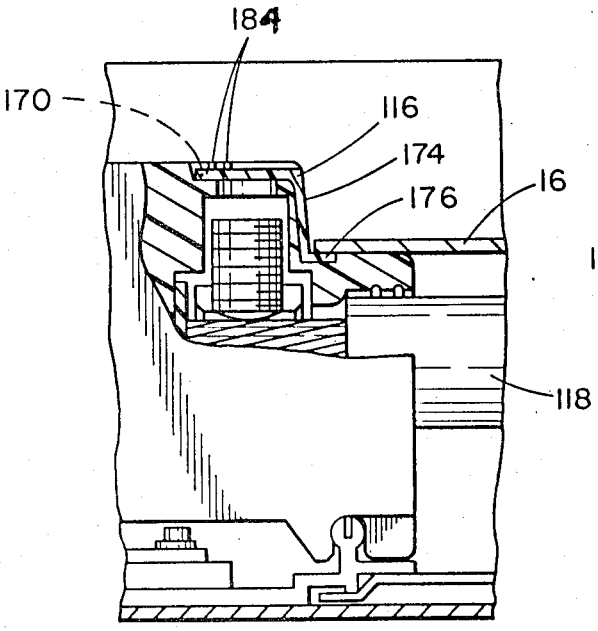
FIG. 9 is a fragmentary view illustrating the circuit breakers load connection closure member in closed position.
Figure 12:
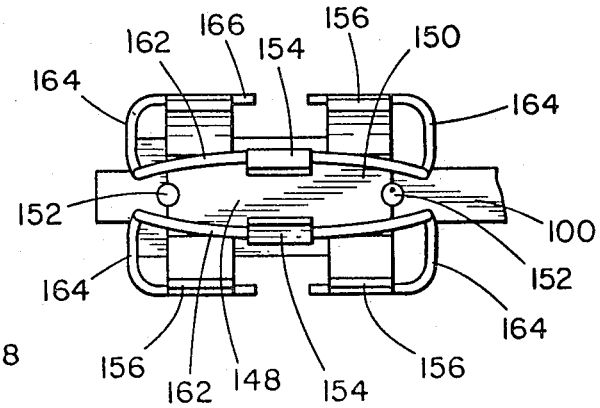
FIG. 12 is a bottom elevational view of the jaw assembly.
Figure 13:
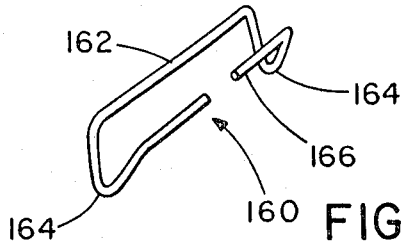
FIG. 13 is an isometric view of one spring member of the jaw assembly.

The leg 168 overlaps a pair of spaced openings 178 in the wall 44 which are aligned with respective lug connectors 180 of the terminal assembly 108 to permit insertion of a tool 182 for operating the lug connectors to connect or disconnect the load wires 118, when the door is open as shown in FIG. 8.

In the open position it will be noted that the door 116 is moved past a vertical plane so that the weight of the door holds the door in open position and eliminates the need for manually holding the door in such position.

A pair of short spaced ribs or projections 184 are provided on the side margins or edges of recess 172 adjacent the hinge pins 170 and the undercut. These ribs project into the recess 172 but are spaced from the bottom of the recess by the thickness of the door. When the door is closed the ribs 184 engage the side edges of the door leg 168 to require some additional force for moving the door past the ribs 184, after which, the pressure, which flexes the door slightly, is relieved, and the door snap fits into the recess 172. For opening movement a slight force is simply exerted against the leg 174 in the opening direction to move the door past the ribs 184 whereafter the door is moved past the vertical plane and the weight of the door holds the door in open position.

The circuit breaker 10 of course is mounted in the panelboard 12 before the interior trim 14 is installed by engaging one of the housing mounting rail recesses 38 with a respective mounting rail or rib 28 and pivoting or rotating the breaker about the longitudinal rib axis to engage the jaws 102 with a respective bus stab 24. The compartment barriers or partitions 26 between adjacent bus stabs 24 are engaged in the corresponding base recesses 42 and thereafter the other mounting rail recess 38 engages the other mounting rib 28.

A voltage reject wall portion 186 is formed on the lower wall 36 of the breaker base 32. If the panelboard assembly 12 is adapted to carry higher voltages than the breaker is designed to carry, a wall portion 188 indicated herein by broken lines in FIG. 2 is formed on insulator 18, as shown in the aforementioned U.S. Pat. No. 4,142,225. The wall portion 188 is located adjacent the mounting ribs 28 and engages the voltage reject wall portion 186 to prevent the breaker from engaging the adjacent mounting rib 28 and therefore from properly engaging the jaws 102 with the bus stab. The inability to seat the breaker on both mounting rails alerts the installer to the mismatch of the breaker with the panelboard to insure that a properly selected breaker must be used.

If the breaker is adapted for insertion in the panelboard assembly 12 both mounting ribs 28 engage in the mounting recesses 38 and each terminal assembly 102 engages with a respective U shaped bus stab 24. The installer then opens door 116, which remains in the open position, as explained, and after the load wires are connected to the respective connectors, the door is closed to seat in the corresponding recess 172 of top wall 44. The trim is now installed to overlap tabs 176 and thereafter prevent access to the door without removal of the trim.

If the circuit breaker 10 had been in the trip position shown in FIG. 7, it is latched by moving the hand 68 to the OFF position as shown in FIG. 5 until the stop tab 86 engages the back leg of link 74. This movement pivots the handle arm 64 counterclockwise about pivot 62 as seen in FIG. 5, while pivot 76 moves to the upper end of slot 80 and the link 74 pivots slightly clockwise about pivot 76. The distance between back leg of the handle arm 64 and the back leg of link 74 is increased by this movement, and therefore springs 70 are tensed between the link and handle arm to bias pin 76 against the ends of respective slots 80.

Movement of the pins 76 pivots the opposite ends of the translator links 56 against a respective stop 190 while drawing or pulling the pin 144 upwardly in slot 144 to pivot latch 126 clockwise against the bias of spring 132. Movement of latch 126 clockwise engages the latch with the step on lever arm 124 to latch the breaker. The stops 190 are simply a pair of tabs formed on respective frame wall 58 and each has an inclined lower surface so that when bent inwardly the point on inclined surface at which the links 56 are engaged controls the link and latch alignment to ensure that translatable pivot 144 is just below a radial line between translatable pivot 76 and pivot 130 or above that line, which would hamper movement of pin 144 through that line. The alignment of pivot 144 adjacent the radial line between pivot 76 and pivot 130 aligns the longitudinal axis of link 56 with corresponding latch axis to hold pivot 76 in one limit position in slot 80.

Thereafter the handle arm 64 is moved to the ON position shown in FIG. 6 to pivot the link 74 counterclockwise about pivot 76 under the tension of springs 70 while bringing the pivot 88 into alignment with pivot 76 and the pivot connection between link 84 and blade 90 thereby forcing the lower link 84 of the toggle downward to close contacts 94 and 96, which are held closed and against contact bounce by springs 146.

Had the breaker been in the ON position when handle arm 64 is moved to the OFF position link 74 moves clockwise about pivot 76 to draw the lower link 84 upward and open contacts 94 and 96, whereafter the contacts may be closed as explained by moving the handle to the ON position.

If an excessive or fault current above a predetermined value should pass through the contacts 94 and 96 and through conductor 106, the magnetic field generated thereby renders the yoke 112 effective to attract the armature 136 against the bias of spring 138. The armature 136 pulls the insulator link 140 downward while the inclined cam surface 141 on the link engages the surface 142 on the trip bar 122 to pivot the trip bar counterclockwise against the bias of spring 134. As the latch 126 is rendered free by this movement of bar 122, the latch spring 132 pivots latch 126 counterclockwise to pull pin 144 and link 56 down in conjunction with the movement of link 140. The movement of the link 140 adds to the force of spring 132 pulling pin 144 and the translator link 56.

The opposite end of link 56 follows the movement of pin 144 in slot 143 to move the link pin 76 downward and to the right in slot 80. The pin on cradle arm 78 engages link 74 to pivot the link 74 clockwise about pin 76 and as the link 74 pivots, the in line position of link pivots 76, 88 and the pivot of link 88 with blade 90 is disturbed. The large force of springs 70 are then immediately effective to move pivot 88 upwardly for separating contacts 94 and 96 rapidly, while the handle is moved to the Trip position shown in FIG. 7. Simultaneously a trip flag or indicator 192 on the end of one translator link 56 adjacent the handle 68 is moved into alignment with a transparent window 194 in wall 44 to clearly indicate the tripped condition of the breaker. With contacts 94 and 96 open, armature 136 is restored to move link 140 upward, while the trip bar is free to pivot back to the latch position under the influence of spring 134 to permit engagement with latch 126, when the handle is moved to the OFF position.

In the event a predetermined overcurrent which is less than the fault current had heated the bimetal 110 over a selected time period to cause it to engage arm 120, the trip bar 122 is pivoted counterclockwise to free the latch 126. The spring 132 then pulls the latch 126, pin 144 and the translator link 56 downward to translate pivot 76 and in turn engage the pin of cradle arm 78 for breaking the toggle. The toggle links 74 and 84 collapse under the force of spring 70 as described to separate the contacts 94 and 96 and move the handle 68 and flag 192 to the Trip position.

From the trip position the handle is thereafter moved from the trip position to the OFF position to reset the breaker as described and from the OFF position to the ON position to close the contacts 94 and 96 all as described.

The foregoing describes an improved circuit breaker whose inventive concepts are believed set forth in the accompanying claims.

What we claim is:

1. A circuit breaker comprising:

an insulating housing, a handle arm pivotally supported in said housing, a contact blade having a blade contact, a stationary contact positioned for engagement by said blade contact, a pair of pivotally interconnected toggle links with one of said links having a first translatable pivot and the other link having a blade pivot connection with said blade, said translatable pivot having a set position and a trip position, a toggle spring interconnecting said handle arm and said one link, securing means for securing said first translatable pivot against translation in response to pivoting movement of said handle arm in one direction from a selected position to tense said toggle spring and move said translatable pivot to said set position and for thereafter enabling the pivoting movement of said handle arm in a direction opposite said one direction to align the pivot interconnection of said links with said blade pivot connection said said translatable pivot along a common line while retaining said translatable pivot in said set position to resist the tension of said toggle spring and engage said contacts with each other, and current controlled means responsive to a current greater than a predetermined value passing through said contacts for controlling said securing means to enable said toggle spring means to translate said translatable pivot from said common line set position to said trip position and for disengaging said contacts and for moving said handle arm in said one direction to said selected position;

said current controlled means including a biased armature moved against said bias in response to the passage of said current greater than said predetermined value, and link means connected to said armature and to said translatable pivot for providing a positive driving force to release said securing means and to effect disengagement of said contacts in response to the movement of said armature against said bias.

2. The circuit breaker claimed in claim 1 in which said securing means includes a biased latch pivotally supported within said housing and operably associated with said first translatable pivot, said latch biased toward a first position corresponding to the trip position of said translatable pivot and pivotable to a second position corresponding to said translatable pivot in response to movement of said handle arm in said one direction, and a biased trip bar pivotally supported within said housing and engaging said latch in response to the movement of said latch to said second position to prevent movement of said latch toward said first position.

3. The circuit breaker claimed in claim 2 wherein said link means comprises an insulating link connected at one end to said armature and at an opposite end to said latch and having a portion intermediate its opposite ends defining a cam surface engaged with said trip bar in response to said translatable pivot assuming said set position, said surface adapted to pivot said trip bar and subsequently pull said latch to said first position in response to movement of said armature against said bias.

* * * * *